US005775136A

United States Patent [19]

Chao-Cheng

[11] Patent Number: 5,775,136

[45] Date of Patent: Jul. 7, 1998

[54] SPRAY DYEING APPARATUS WITH BREADTH EXPANSION AND VIBRATION-ENHANCED DYEING OPERATION

[76] Inventor: Chiang Chao-Cheng, 5F-2, No.455, Chung Cheng Road, Yung-Ho City Taipei Hsien, Taiwan

[21] Appl. No.: 828,884

[22] Filed: Mar. 31, 1997

[51] Int. Cl.[6] ..... D06B 3/28

[52] U.S. Cl. ..... 68/15; 68/18 F; 68/20; 68/62; 68/178

[58] Field of Search ..... 68/15, 20, 18 F, 68/62, 177, 178

[56] References Cited

U.S. PATENT DOCUMENTS

| | | | |
|---|---|---|---|
| 3,971,236 | 7/1976 | Bene | 68/177 X |
| 5,014,525 | 5/1991 | Bene | 68/178 X |

FOREIGN PATENT DOCUMENTS

| | | | |
|---|---|---|---|
| 0334749 | 9/1989 | European Pat. Off. | 68/178 |
| 78880 | 7/1976 | Japan | 68/177 |

*Primary Examiner*—Philip R. Coe

[57] ABSTRACT

A spray dyeing apparatus includes a fabric storage tank and a fabric guide tube disposed above and connected to the fabric storage tank to define a continuous loop for fabric. A pump and a blower are provided to pressurize and convey dye and air into the fabric guide tube via spray nozzles disposed on upper side of the fabric guide tube and directing nozzles arranged on a bottom support plate of the fabric guide tube. The bottom support plate has a support surface having a sufficient width to allow the breadth of the fabric to be substantially fully expanded in moving through the fabric guide tube. The directing nozzles are provided on the support plate in a spaced manner to generate high speed air streams in the downstream direction which are confined above the support plate to have the fabric floating above the support plate and moving in the downstream direction. The high speed air streams also create a low pressure zone under the fabric so as to induce a violent vibration on the fabric by means of the air streams and the pressure difference between the upper and lower sides of the fabric. The spray nozzles are provided on the upper side of the fabric guide tube to spray atomized dye onto the expanded fabric.

15 Claims, 12 Drawing Sheets

SPRAY DYEING APPARATUS WITH BREADTH EXPANSION AND VIBRATION-ENHANCED DYEING OPERATION

FIELD OF THE INVENTION

The present invention relates generally to a spray dyeing apparatus and in particular to a spray dyeing apparatus having a construction to allow the fabric breadth to be substantially fully expanded during dyeing process with a pressure difference created between the upper side and the lower side of the expanded fabric, together with vibration of the fabric caused by high speed air streams under the fabric, to enhance the dyeing effectiveness and efficiency.

SUMMARY AND BACKGROUND OF THE INVENTION

The term spray dyeing apparatus used herein is intended to indicate a dyeing apparatus in which the liquid dye and other fabric treating agent are brought into contact with the fabric in an atomized form by means of spray nozzles arranged above the fabric. The dyeing apparatus in accordance with the present invention provides a flat fabric support surface of a sufficient width which allows the fabric to be substantially fully expanded in the breadthwise direction when the fabric is moved through the dyeing apparatus so as to receive the atomized dye thereon across the breath thereof to carry out dyeing operation. The present invention also discloses a construction of the dyeing apparatus which comprises a plurality of directing nozzles located under the expanded fabric to generate high speed air streams to move and support the fabric on the support surface. The high speed air streams also create a low pressure zone under the expanded fabric which causes a pressure difference between the upper and lower sides of the expanded fabric. The pressure difference causes the fabric to violently vibrate so as to enhance the penetration and diffusion of the dye into the fabric. Thus a dyeing operation of high efficiency, low energy consumption, low bath ratio and low pollution may be achieved.

The present invention is particularly related to a dyeing apparatus in which an effect that is caused by the high speed air streams under the expanded fabric creating a low pressure under the fabric and the massive transfer of energy between the high speed air streams and the fabric causing the fabric to continuously move downstream leads in a high efficient penetration and diffusion of the dye within the fabric and also a very effective way to remove un-wanted particles or impurities from the fabric and to clean, rinse and bleach the dyed fabric in a very efficient way so as to complete the overall dyeing operation in a very short time as compared with the conventional dyeing apparatus.

In the conventional air flow type or liquid flow type dyeing apparatus, the fabric is moved by means of a fabric driving wheel and a driving nozzle set. The fabric is constrained to be in the form of a tight bundle, similar to a rope, to pass through the throat of the driving nozzle. The fabric is also constrained in a circular fabric guide tube having a limited, small diameter in order to prevent the kinematic energy of the moving fabric from losing due to expansion of the fabric and thus maintain the speed of the fabric in a desired level. Thus, the fabric is constrained to the form of rope in moving through the fabric guide tube inside which the dyeing operation is actually carried out. The conventional air flow type or liquid flow type dyeing apparatus is generally designed to make use of the driving force generated by air stream nozzles or liquid stream nozzles (the driving nozzle) or the combination thereof to force the fabric to move into and through the fabric guide tube. The technique of the liquid flow type dyeing apparatus has been disclosed in certain prior art patents so that no further discussion is given here. As to the air flow type dyeing apparatus, it is defined as comprising an air driving nozzle mounted on the liquid driving nozzle or mounted at the upstream and downstream side to provide auxiliary driving force and to soften the hard driving action generated by the liquid driving nozzle and also to provide a dyeing operation of low bath ratio. In general, the air flow type dyeing apparatus is classified as high temperature, high pressure type and regular temperature, regular pressure type, which comprises, in the construction, a fabric storage tank, a fabric guide tube, a fabric driving wheel, a dye driving nozzle set, an air driving nozzle set, a fabric folding device, a dye pump, a blower, a heat exchanger/filter device for temperature control and a control unit. In construction, the fabric guide tube is arranged above the fabric storage tank and extending in the same axial direction. The upstream end and the downstream end of the fabric guide tube are respectively connected to and in communication with a lateral side end of the fabric storage tank to allow the fabric to be driven and guided by the driving wheel from the fabric storage tank to a driving nozzle set. By means of the dye and air streams generated by the driving nozzle set, the fabric is driven into and through the fabric guide tube and eventually moving from the downstream side back into the fabric storage tank. The dye and air exiting the fabric guide tube are re-circulated through respective return tubes to the dye pump and the air blower. The fabric that moves into the fabric storage tank through a laterally rear side of the tank is then moved toward the laterally front side and driven out of the fabric storage tank by the fabric driving wheel to continuously circulate through the fabric storage tank and the fabric guide tube.

FIGS. 1 and 2 respectively show the conventional air flow type and liquid flow type dyeing apparatus, both comprising a fabric storage tank A and a fabric guide tube A1. The fabric guide tube A1 has a dye driving nozzle A11 (for liquid flow type) or an air driving nozzle A12 (for air flow type) at an upstream inlet. For simplicity, the dye driving nozzle A11 and the air driving nozzle A12 are generically referred to as driving nozzle and designated with reference A2 in the following description. The fabric guide tube A1 has a downstream outlet connected to and in fluid communication with the fabric storage tank A to define a continuous fabric circulation loop through which a fabric to be dyed, designated with reference B, is moved. During the dyeing operation, the fabric B inside the fabric storage tank A is driven therefrom to the driving nozzle A2 by means of a fabric driving wheel A3 and is dyed by means of the dye and/or air stream generated by the driving nozzle A2. The dye/air stream also forces the fabric B to move through the fabric guide tube A1 and back into the fabric storage tank A. The dye C inside the fabric storage tank A is conducted by means of a return tube A4 located under the fabric storage tank A to the dye pump A5. The air that flows into the fabric storage tank A with the fabric B is conducted by an air return tube A6 disposed above the fabric storage tank A to the air blower D. The fabric B that moves out of the fabric guide tube A1 and enters the laterally rear side of the fabric storage tank A is driven frontward by means of for example inclination of the fabric storage tank A or gravity or potential difference thereof to repeat the dyeing cycle.

Thus, in the conventional air flow type dyeing apparatus, the movement of the fabric is achieved by the fabric driving wheel A3 and the dye/air stream generated by the driving nozzle A2 that is located at the laterally front end upstream inlet so as to allow the fabric B to move into and through the fabric guide tube A1 and thus providing a dyeing operation of low bath ratio. In the conventional apparatus, the driving nozzle A2 is constructed to have a nozzle opening or mouth of circular cross section, as shown in FIGS. 3 and 4. In order to control the flow rate of the stream from the driving nozzle A2, a variety of adjustable construction of the driving nozzle have been developed which gradually takes place of the driving nozzles of fixed nozzle opening size or exchangeable nozzles. In fact, the operation of the adjustable driving nozzle A2 in the dyeing process is substantially identical to the fixed type nozzle, for the fabric B is still constrained to be in the form of a rope in passing through the nozzle A2. Since the adjustable driving nozzle constitute no improvement to be discussed in the present invention, no further detail will be given. A1 though in the air flow type and liquid flow type dyeing apparatus shown in FIGS. 1 and 2, identical members or parts are designated with the same references, yet description that is given as follows is based on the air flow type dyeing apparatus. The fabric B passes through the central throat A22 of the ring opening A21 of the driving nozzle A2 with the due/air stream from the nozzle A2 surrounds the fabric at the downstream side and forms a constraint force on the fabric B. The dye/air stream leaving the nozzle A2 spreads and transfers the kinematic energy thereof to the fabric to generate a driving force in the downstream direction. To prevent the energy from being over-spread and thus causing significant reduction of the fabric speed and to achieve the desired dyeing effect, in the conventional air flow type or liquid flow type dyeing apparatus, both the driving nozzle A2 and the fabric guide tube A1 through which the fabric B is to move have a circular cross section to provide transfer and saving of energy. However, using such a constraint configuration of driving nozzle A2 for driving the fabric B downstream frequently causes damages on the fabric B due to the fact that when the fabric B moves through the throat of the driving nozzle A2 and the fabric guide tube A1, the fabric is subject to the constraint of the throat of the driving nozzle A2 and the fabric guide tube A1 to force the fabric B to form a rope like configuration which requires the fabric to have a large speed in passing through the nozzle, thus causing violent impact of the fabric B onto the side walls of the throat of the driving nozzle A2. Also, when the jet force from the driving nozzle A2 is excessive, the fabric B is also subject to great impact from the dye/air stream, which may cause damage on the fibrous structure of the fabric B so as to lead in separation and detachment of fibers. On the other hand, lowering down the jet force of the driving nozzle A2 may not provide a sufficient penetration force of the dye into the rope-like configuration of the fabric B. The moving speed of the fabric B is also reduced and thus lengthens the circulation period of the fabric B.

Further, when the fabric B passes through the driving nozzle A2, the fabric B is usually folded breadthwise and tightly squeezed together. Folding traces are thus formed on the fabric B. Although compacting the fabric B to form a rope-like configuration is helpful in transferring energy from the dye/air stream to the fabric B and moving the fabric B downstream, yet with such a compact configuration of fabric, it is difficult to have the dye uniformly and sufficiently penetrate into the fabric B. In other words, it requires great energy to drive the dye deep into the fabric B and also to expel the dye that has already penetrated into the fabric B to get out of the fabric B so as to allow new dye to move in. Thus to overcome such a problem, conventionally, the dyeing cycle is lengthened and dye streams are continuously provided by the driving nozzle A2 to impact onto the fabric B. This makes the dyeing operation time- and labor-consuming.

The momentum that the driving nozzle A2 applies to the fabric B may be calculated on the basis of the speed when the fabric B is passing through the throat A22 of the driving nozzle B. When the fabric B leaves the throat A22, the velocity reduces for the cross-sectional area of the ring-like mouth A21 of the driving nozzle A2 is smaller than that of the fabric guide tube A1 which causes the dye flow or air flow to spread out and the spread of the air flow or dye flow makes the fabric B slow down. Since the fabric B itself is not a fluid, it has to fold or overlap to accommodate the reduction of speed. This is particularly significant for all cotton fabric or fabric having a great unit weight. Thus the fabric B may get over-crowded and squeezed inside the fabric guide tube A1, causing an action like a piston inside a cylinder bore. Serious folding line problem may thus arise. Also, the friction between the fabric guide tube A1 and the fabric B is increased. As a matter of fact, in the conventional air flow type and liquid flow type dyeing apparatus, once the fabric B leaves the driving nozzle A2, due to the increase of space, most of the momentum is lost with the spread of the air flow or dye flow so that the penetration of the dye into the fabric B is reduced. Although theoretically, the expansion of the air stream or air flow may open the fabric B when the fabric B is leaving the fabric guide tube A1, yet since the fabric B is constrained to the form of a rope for quite a long during the dyeing operation, it is sometimes not possible to have the fabric B opened properly. Thus, conventionally, the air flow type dyeing apparatus is not suitable for all cotton fabric or fabric having great unit weight. Further, in the conventional air flow type dyeing apparatus, the fabric is only subject to the action of the driving nozzle A2, un-dyed spots may be found in the fabric B and thus the effectiveness of dyeing is poor.

Conventionally, the air flow type dyeing apparatus handles fabric in a batch manner and the quantity of fabric that a batch may take is dependent upon the size of the fabric storage tank. The most common capacity of the fabric storage tank is between 100–200 Kg. If a batch is greater than the capacity, then the dyeing operation must be carried out with more than one dyeing device. Alternately, the dyeing apparatus may be designed with a very large fabric storage tank which is divided into several channels each serving as an independent fabric storage tank. Besides the capacity of the fabric storage tank, the productivity capacity of a dyeing apparatus is also determined by the period of the dyeing cycle. Generally, a dyeing cycle takes approximately 2minutes which should not be shortened significantly in order to obtain an effective dyeing.

The movement of the fabric B inside the fabric storage tank A is usually driven by the inclination provided inside the tank A and the potential caused by the stack of fabric B inside the tank. This is particularly true for air flow type dyeing apparatus. Thus, the air flow type dyeing apparatus usually adapts a configuration of for example "J", "O" or "U" shape to provide such an altitude difference for causing movement of the fabric B inside the fabric storage tank A. Further, to protect the fabric B from over-friction with the fabric storage tank A, usually a layer of low friction coefficient material (not shown) is provided inside the fabric storage tank A. Thus, besides the difference in the factors discussed above, such as gravity and potential energy, bath ratio, momentum of dyeing fluid and the acceptable folding line for a given fabric, most of the dyeing apparatus, although having different configuration, are operated in accordance with the same principle to achieve dyeing effect.

FIG. 5 shows a prior art liquid flow type dyeing apparatus created by the present inventor, which is disclosed in Taiwan utility model No. 89941, Chinese utility model No. ZL 93209236.5, Chinese patent No. 93105099.5 and U.S. Pat. No. 5,381,678. The present invention is an improvement over the liquid flow type dyeing apparatus.

As shown in FIG. 5, the previous liquid flow type dyeing apparatus of the present inventor has a configuration similar to the conventional liquid flow type dyeing apparatus shown in FIG. 1 which comprises a fabric storage tank A and a fabric guide tube A1 disposed above the fabric storage tank A with laterally front and rear ends of the fabric guide tube A1 connected to the fabric storage tank A to define a continuous path for fabric B. The front inlet of the fabric guide tube A1 has a driving nozzle A2 and the laterally front end of the fabric storage tank A has fabric driving wheel A3 to convey the fabric B from the fabric storage tank A to the driving nozzle A2 and then into the fabric guide tube A1 and finally back to the fabric storage tank A. The driving nozzle A2 generates dye stream to carry out dyeing operation on the fabric B and drives the dye C and the fabric B to pass through the fabric guide tube A1 and into the fabric storage tank A. The dye C collected inside the fabric storage tank A is then guided via a return tube A4 to a dye pump A5 which pressurizes and conveys the dye, via a dye circulation tube A8, to the driving nozzle A2 to be injected thereby onto the fabric B to drive the fabric B through the fabric guide tube A1. The fabric guide tube A1 comprises a plurality of directing nozzles A61 arranged on the bottom of the fabric guide tube A1 so as to allow the dye C which is pressurized by the pump A5 and conveyed through a tube A7 to be injected in a downstream direction by the directing nozzles A61 for enhancing the movement and dyeing effectiveness of the fabric B.

In view of the drawbacks of the above described prior art dyeing apparatus, the present invention provides an improved air flow type spray dyeing apparatus.

Thus, an object of the present invention is to provide an air flow type spray dyeing apparatus wherein no driving nozzle is provided at the front upstream inlet of the fabric guide tube and a substantially flat support having a sufficient width is provided on the bottom of the fabric guide tube to allow the breadth of the fabric to be substantially fully expanded in moving through the fabric guide tube so that the fabric is no longer constrained by a small cross section of the driving nozzle and the small diameter of the prior art fabric guide tube and thus the abrasion of the fabric and the folding line problem of the fabric may be effectively eliminated.

Another object of the present invention is to provide a spray dyeing apparatus wherein the fabric guide tube comprises a plurality of spaced directing nozzles disposed on the bottom of the fabric guide tube to generate high speed air streams under the fabric to float, support and move the fabric and a plurality of spray nozzles on the upper side of the fabric guide tube to apply atomized dye liquid onto the fabric so as to effect a dyeing operation with a small quantity of dye. Thus a dyeing apparatus of low bath ratio, low energy consumption and low pollution is provided.

A further object of the present invention is to provide a spray dyeing apparatus which generates a plurality of high speed air streams to act upon the underside of the substantially fully expanded fabric so as to induce a violent vibration on the fabric which is partially caused by the impact of the air streams onto the fabric and partially by the pressure difference between the upper side and lower side of the fabric induced by the high speed of the air stream, which vibration enhances the penetration and diffusion of dye into the fabric and thus significantly increases the degree of exhaustion of dye.

A further object of the present invention is to provide a spray dyeing apparatus wherein high speed air streams are generated under the substantially fully expanded fabric and a low pressure zone is created under the fabric which allows the fabric to be driven toward the high speed air streams to force the air to flow out of the fabric from two breadthwise sides thereof for maintaining the full expansion of the fabric.

A further object of the present invention is to provide a spray dyeing apparatus wherein high speed air streams are generated under the fabric to cause violent vibration of the fabric which not only achieves a dyeing operation with small quantity dye of high concentration, but also effects the removal of impurity or contaminant from the fabric.

A further object of the present invention is to provide a spray dyeing apparatus which allows liquid, such as dye or fresh water, to be injected to both the upper and lower sides of the fabric so as to effect a rinsing operation or to effect a dyeing operation for heavy fabric.

To achieve the above objects, there is provided a spray dyeing apparatus comprising a fabric storage tank, a fabric guide tube, a distribution tube, a plurality of directing nozzles, a flat support plate, spray nozzles, a dye pump, a blower, a fabric folding plate, a fabric driving wheel, a gas/liquid separation net, heat exchangers, a filter and other piping and control elements, wherein the fabric storage tank and the fabric guide tube are connected to each other to define a continuous loop for fabric. The dye and air are pressurized by means of the pump and the blower and conveyed into the fabric guide tube by means of the spray nozzles and the directing nozzles to have the fabric dyed. The fabric is driven by the air streams generated by the directing nozzles to move through the fabric guide tube. The improvement comprises a substantially flat support is provided on the bottom of the fabric guide tube, having a sufficient width to allow the breadth of the fabric to be substantially fully expanded in moving through the fabric guide tube. The directing nozzles are provided on the support plate in a spaced manner to generate high speed air streams in the downstream direction, the air streams being confined above the support plate to have the fabric floating above the support plate and moving in the downstream direction. The spray nozzles are provided on the upper side of the fabric guide tube to spray atomized dye onto the expanded fabric. The high speed air streams generated by the directing nozzles also cause a low pressure zone under the fabric so as to induce a violent vibration on the fabric by the air streams and the pressure difference between the upper and lower sides of the fabric. Thus a dyeing apparatus of high efficiency, lower power consumption, low bath ratio and low pollution is provided.

BRIEF DESCRIPTION OF THE DRAWINGS

The present invention will be better understood from the following description of preferred embodiments thereof, with reference to the attached drawings, wherein.

DETAILED DESCRIPTION OF THE PREFERRED EMBODIMENTS

Figure 8:
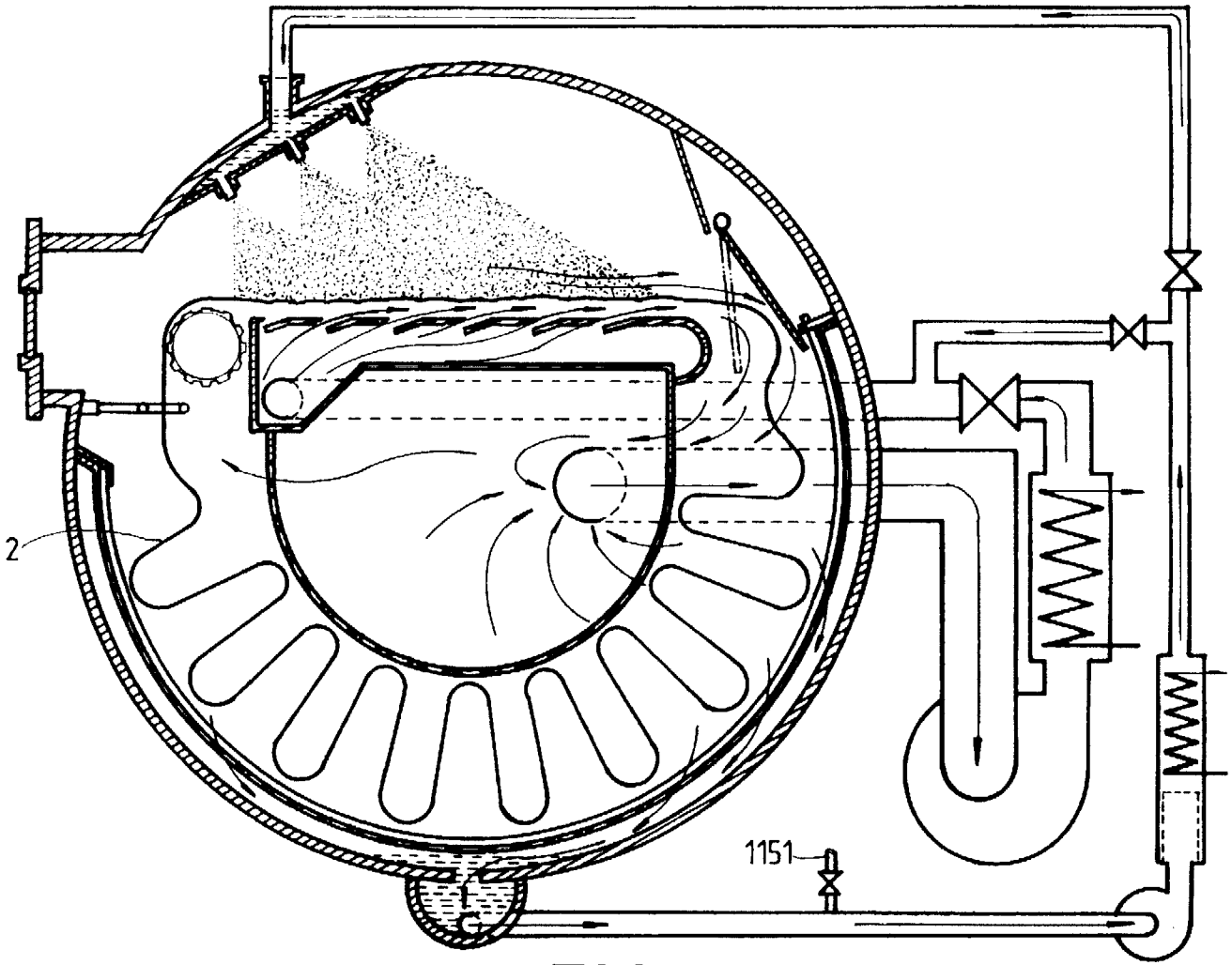
FIG. 8 is schematic side elevation, cross-sectional view showing a spray dyeing apparatus constructed in accordance with the present invention.

With reference to the drawings and in particular to FIG. 8, which shows a cross-sectional view of a spray dyeing apparatus in accordance with the present invention, the spray dyeing apparatus of the present invention comprises a fabric storage tank 1, a fabric guide tube 11, a distribution tube 12, directing nozzles 121, a support plate 13, spray nozzles 14, a dye pump 15, a blower 16, a fabric folding plate 17, a fabric driving wheel 18, an inner holed plate or net 19, a dye heat exchanger 154, a filter 153 and a dye feeding inlet 1511, a dye return tube 151, a dye conveyor tube 152, an air return tube 161, an air conveyor tube 162, a secondary dye conveyor or by-pass tube 165 and a dye flow control valve 166.

Figure 9:
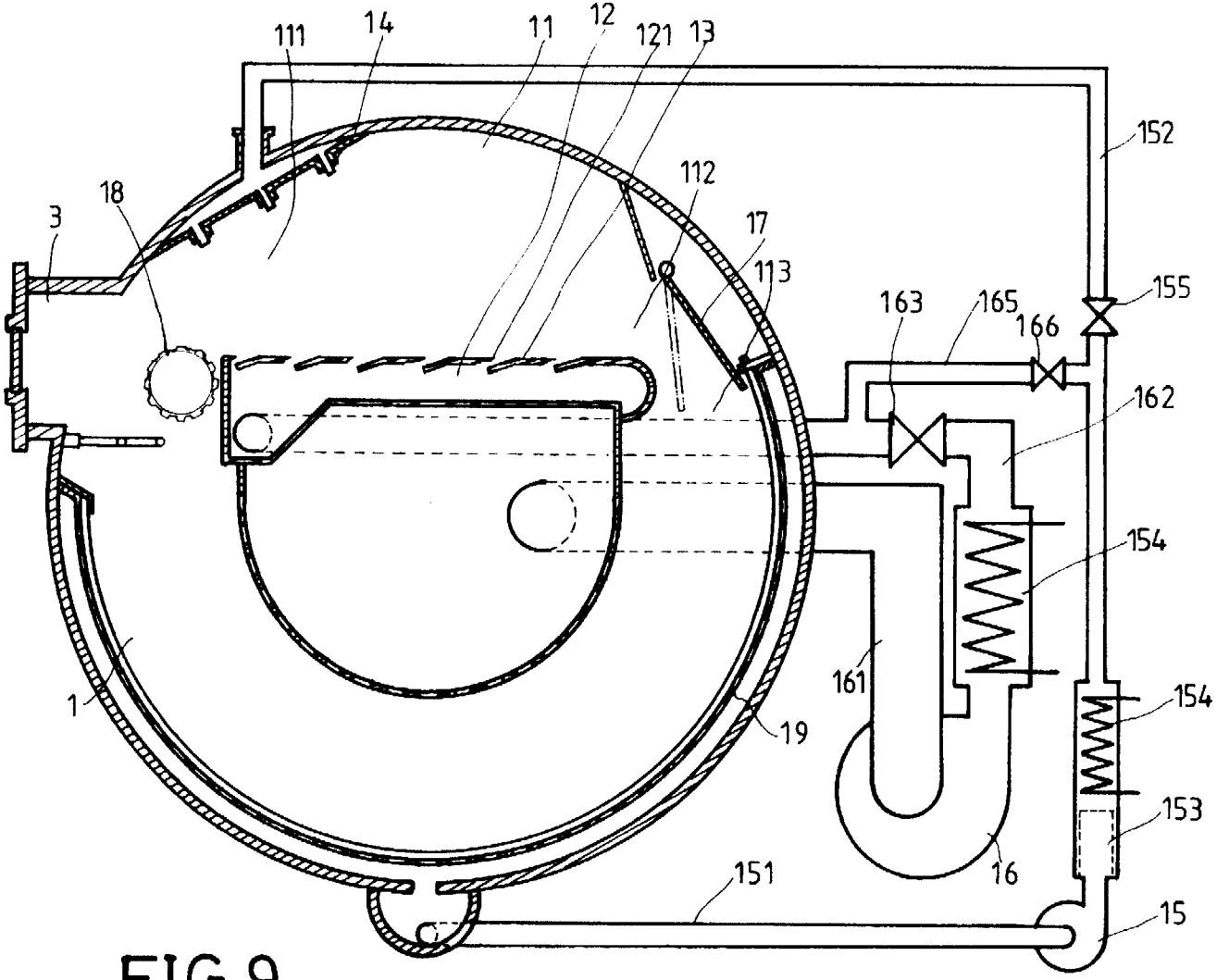
FIG. 9 is also a cross-sectional view of the spray dyeing apparatus of the present invention.
Figure 10:
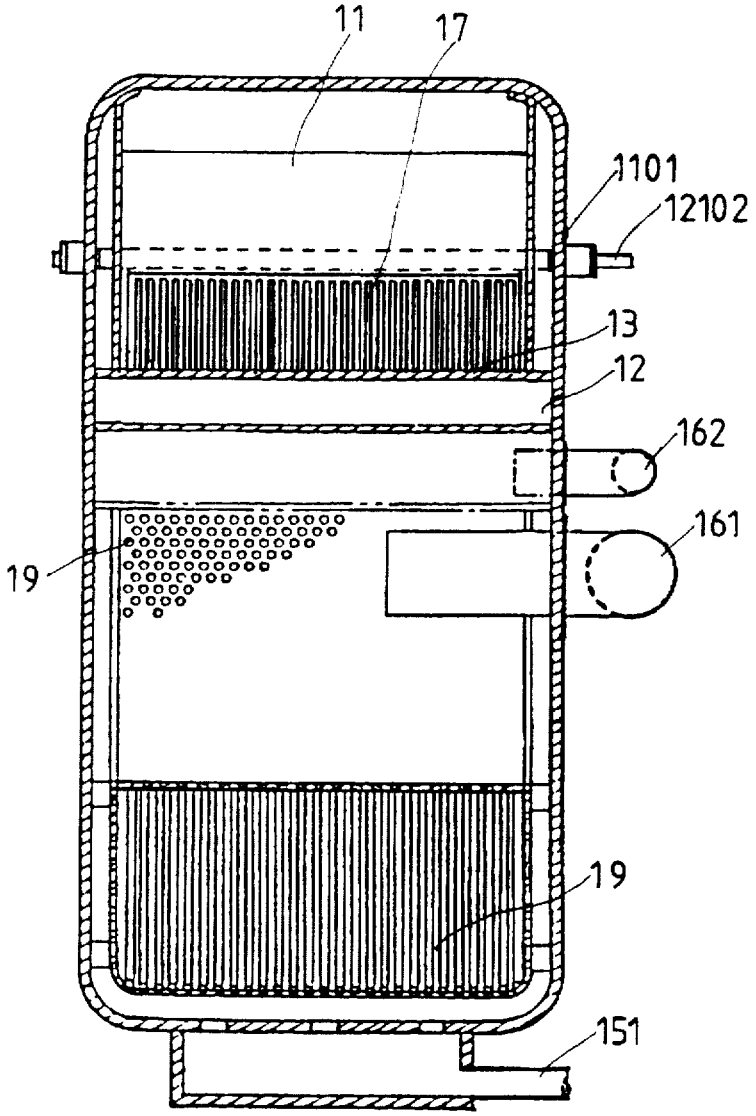
FIG. 10 is a sectional view of the spray dyeing apparatus of the present invention.

With reference to FIGS. 8–10, the fabric storage tank 1 has a configuration of circular tube for high pressure and high temperature dyeing operation, while for regular pressure and regular temperature, the configuration is generally a square tube which is to enhance the movement of the fabric inside a low bath ratio dyeing apparatus, preferably O-, U- or inverted L-shaped construction so as to minimize the space occupied thereby. As shown in FIG. 8, the dyeing apparatus illustrated takes the configuration of an O-shaped cross section with the fabric storage tank 1 defined in the lower portion of the O-shaped configuration. The fabric guide tube 11 is mounted above the fabric storage tank 1, co-extending therewith in the same axial direction which is normal to the drawing plane of FIG. 8. The fabric guide tube 11 has an upstream inlet connected to and communicating with a laterally front end of the fabric storage tank 1 and a downstream outlet 112 connected to and communicating with a laterally rear end of the fabric storage tank 1 so as to define a circular closed loop for the circulation of fabric to be dyed which is designated with reference numeral 2 in the drawing. The lowermost portion of the fabric storage tank 1 is provided with a dye return tube 151. An air return tube 161 is provided above the dye return tube 151. An access hole 3 and a fabric driving wheel 18 are provided at the laterally front end of the fabric storage tank 1, substantially at the interface between the fabric storage tank 1 and the fabric guide tube 11. The fabric 2, which has a given breadth, is driven partly by means of the fabric driving wheel 18 to move from the fabric storage tank 1 into the fabric guide tube 11 to be dyed therein. The fabric guide tube 11 comprises a flat base or bottom 13 having a substantially width (dimension in the axial direction), as shown in FIG. 10, to allow the fabric 2 to be fully expanded breadthwise when the fabric 2 is driven to move through the fabric guide tube 11. The fabric guide tube 11 comprises a plurality of spray nozzles 14 located on an upper side thereof and facing the fabric 2 so as to spray dye onto the fabric 2. A distribution tube 12 is provided under the base plate 13 of the fabric guide tube 12, having a width substantially corresponding to length of the fabric guide tube 11 which is defined as the dimension from the laterally front end of the fabric storage tank 1 to the laterally rear end of the fabric storage tank 1 to allow air to be substantially distributed along the length of the fabric guide tube 11 and a length extending in the axial direction of the dyeing apparatus. Preferably, the base plate 13 constitutes a partition wall between the fabric guide tube 11 and the distribution tube 12. A plurality of directing nozzles 121 are formed on the base plate 13 to substantially extend in the length of the distribution tube 12 and spaced at a pre-determined distance in the width direction of the distribution tube 12. The directing nozzles 121 is configured to face downstream so as to provide air streams under the fabric 2 in the downstream direction, the air being supplied through the distribution tube 12. At a connection section 113 between the downstream outlet 112 of the fabric guide tube 11 and the laterally rear end of the fabric storage tank 1, a fabric folding plate 17 is provided on wall 114 of the connection section 113 by means of pivot. The fabric folding plate 17 is controlled by any known means to swingingly reciprocate about the pivot so as to repeatedly and cyclically get into contact with the fabric 2 during the movement of the fabric 2 and thus force the fabric 2 to be folded in a neat and snug manner in moving from the fabric guide tube 11 back into the fabric storage tank 1. The fabric storage tank 1 is provided with a liquid/air separation net or holed plate 19 which is provided on the bottom of the fabric storage tank 1 with a space defined therebetween so that when the fabric 2 which has dye carried thereon falls back into the fabric storage tank 1, the fabric 2 is supported on the liquid/air separation net 19 to allow the dye to drop through the net 19 by means of gravity and collected in the space between the net 19 and the bottom of the fabric storage tank 1. The dye so collected is then drawn away, via the dye return tube 151, by a dye pump 15. The dye is then pumped through a filter 153 and a heat exchanger 154 to remove un-wanted particles or impurity from the dye and to maintain the dye at a given temperature for dyeing operation. The dye so treated is then conveyed to the spray nozzles 14 through a dye conveyor tube 152.

Figure 13:
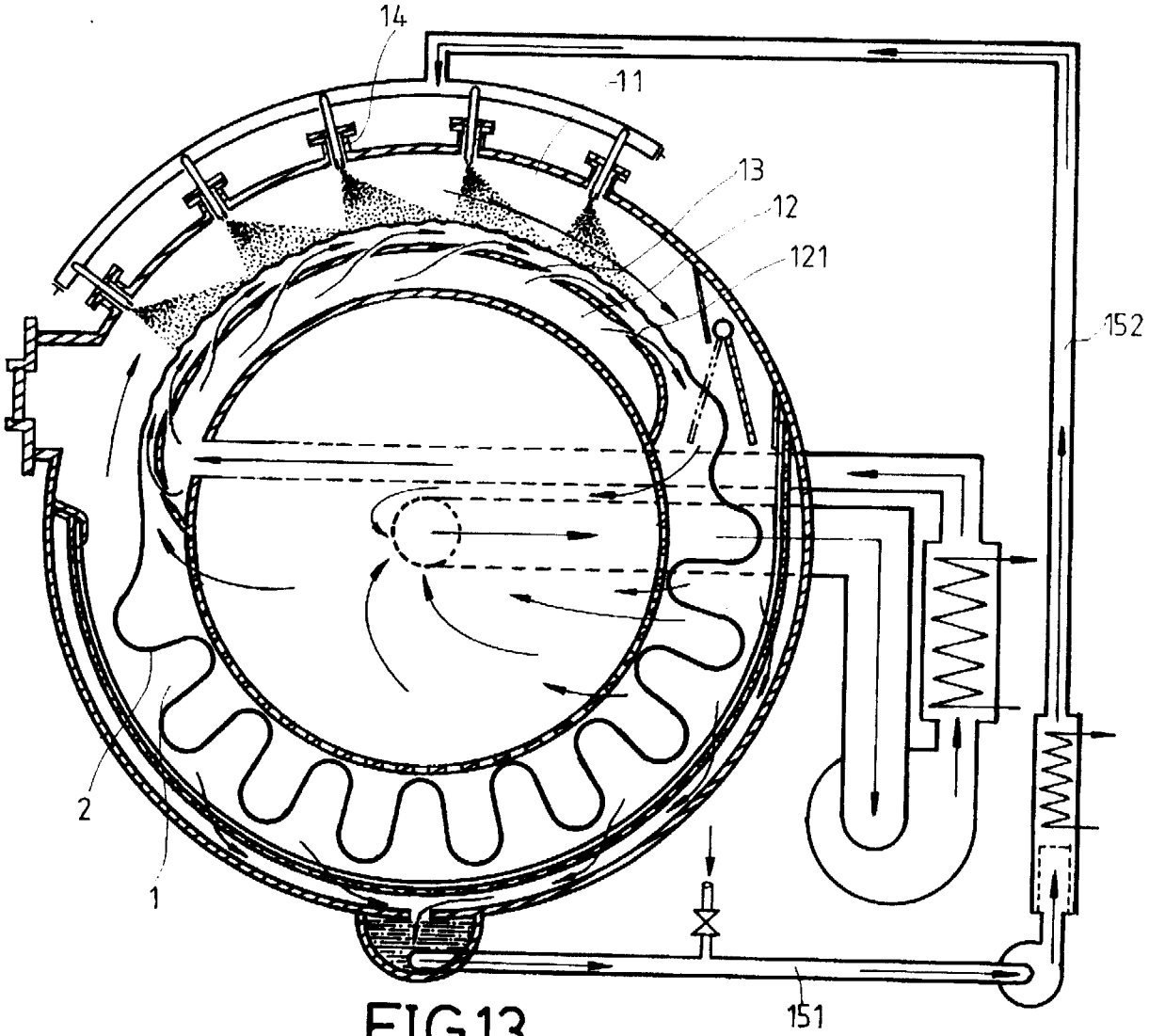
FIG. 13 is a schematic side elevational, cross-sectional view showing a spray dyeing apparatus constructed in accordance with another embodiment of the present invention.

Although in the embodiment illustrated in FIGS. 8 and 9, the support plate 13 defines a support surface of substantially flat structure with a width sufficient to allow the fabric to expand so as to enhance the dyeing effectiveness, yet, as a matter of fact, the support plate 13 may not need to be a flat configuration and it only needs the support plate 13 to be of a sufficient width to allow the fabric to fully expand in order to achieve the dyeing operation provided by the present invention. For example, an another embodiment of the present invention is shown in FIG. 13 wherein the support plate 13 takes the form of an arc substantially concentric with respect to the circular configuration of the dyeing apparatus or the fabric storage tank 1, the width of the base plate 13 in this embodiment being also sufficient for the breadth of the fabric to be substantially fully expanded. Similarly, other configuration of the base plate with a smooth and gradual change in the overall contour also provides the same effectiveness as that shown in both embodiments of FIGS. 8 and 13.

As described above, in the dyeing cycle of the spray dyeing apparatus in accordance with the present invention, the fabric 2 is pulled upward from the fabric storage tank 1 by the fabric driving wheel 18 and then conveyed into the fabric guide tube 11. The dye is conducted to the pump 15 via the dye return tube 151 and then pressurized and conveyed by the pump 15 to the dye conveyor tube 152 via the filter 153 and the heat exchanger 154 and finally reaches the spray nozzles 14 located on the upper side of the fabric guide tube 1 to be sprayed onto the fabric 2 that is moving through the fabric guide tube 11. The dye is absorbed and carried by the fabric 2 toward the outlet 112 of the fabric guide tube 1 and then returns to the fabric storage tank 1. The dye that returns to the fabric storage tank 1 passes through the liquid/air separation net 19 and is then collected at the lowermost portion of the fabric storage tank 1 from which the dye is again conducted to the pump 15 via the dye return tube 151 so as to constitute a continuous dye circulation loop. The dye return tube 151 is provided with a dye feeding inlet 1511 through which dye may be supplemented or other fabric treating agent or chemicals may be added into the dye circulation loop.

The fabric storage tank 1 also has a holed top wall which is spaced from the liquid/air separation plate 19 to define an interior space of the fabric storage tank 1 for receiving the fabric 2 therein. The holed top wall also defines an interior spaced with the underside of the distribution tube 12 to allow air that is separated from the dye or that flows from the directing nozzles 121 as downstream air stream toward the downstream outlet 112 of the fabric guide tube 11 and into the fabric storage tank 1 to be collected therein and conducted by an air return tue 161 to a blower 16. The air is then pressurized by the blower 16 and transported through a heat exchanger 154 to be conveyed into the distribution tube 12 via an air conveyor tube 162. As described above, the pressurized air that is conveyed into the distribution tube 12 via the air conveyor tube 162 is distributed over the plurality of directing nozzles 121 to generate downstream air streams under the fabric 2. The base 13 of the fabric guide tube 11 also serves to constrain the direction of the air streams and to "rebound" a portion of the air streams that collides the fabric 2 and is reflected toward the base 13 by the fabric 2 so as to more effectively support the fabric 2 above the flat base 13.

A by-pass tube 165 is provided between the dye conveyor tube 152 and the air conveyor tube 162. Valves 155, 166 and 163 are respectively provided on the dye conveyor tube 152, the by-pass tube 165 and the air conveyor tube 162 in such a manner that the circulation of fluid in the dye conveyor tube 152 may be selectively directed to the air conveyor tube 162 via the by-pass tube 165. The disposition of the by-pass tube 165 is to provide a more effective dyeing operation on the fabric 2, especially fabric having a greater unit weight, such as fabric having a unit weight of 600 grams per yard length.

The disposition of the by-pass tube 165 to partially direct the fluid circulating inside the dye conveyor tube 152 to the directing nozzles 121 of the distribution tube 12 via the air conveyor tube 162 is also to perform an effective rinsing operation in which fresh water or other suitable rinsing agent takes place of the dye in the circulation loop defined by the dye return tube 151, the pump 15, the filter 153, the heat exchanger 154, the dye conveyor tube 152, the spray nozzles 14, the fabric guide tube 11 and the fabric storage tank 1 and is pumped to spray onto the fabric 2 from the upper side of the fabric 2 to carry out the rinsing operation. The fresh water is also conducted to the distribution tube 2 to be injected to the lower side of the fabric 2 through the directing nozzles 121. This enhances the removal of un-wanted particles or impurities from the fabric 2.

The fluid circulation of the dyeing apparatus of the present invention described above is substantially the same as the conventional dyeing apparatus.

Figure 6:
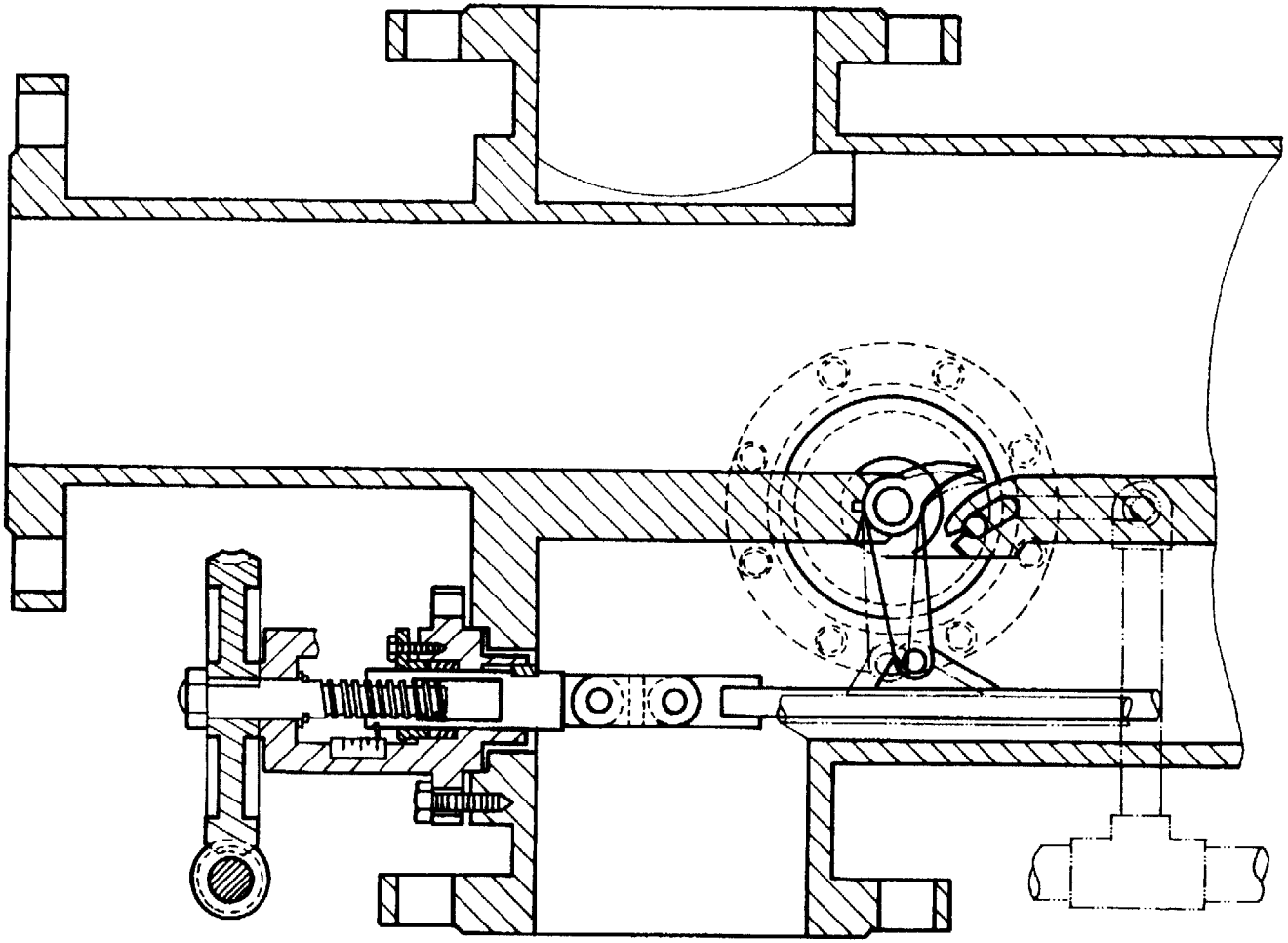
FIG.6 PRIOR ART
FIG. 6 is a cross-sectional view showing an adjustable directing nozzle adapted in the dyeing apparatus shown in FIG. 5.
Figure 7:
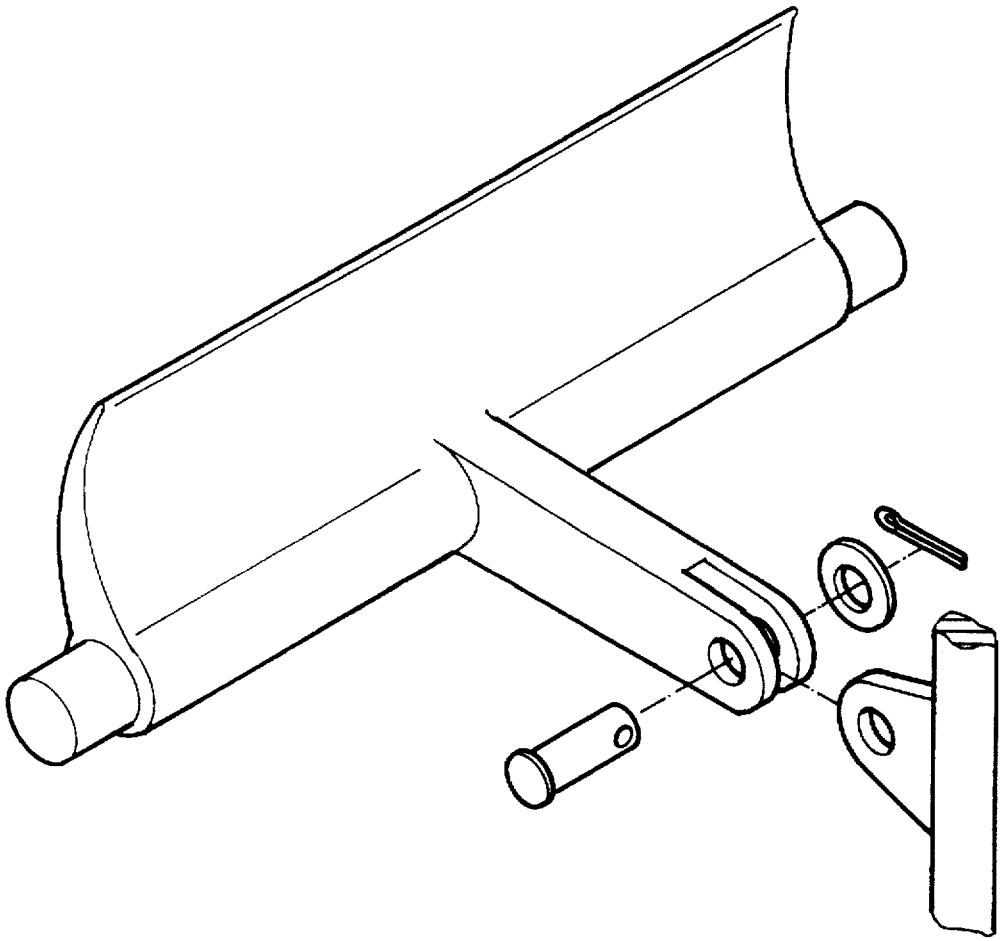
FIG.7 PRIOR ART
FIG. 7 is a fragmentary view of the directing nozzle shown in FIG. 6.
Figure 11:
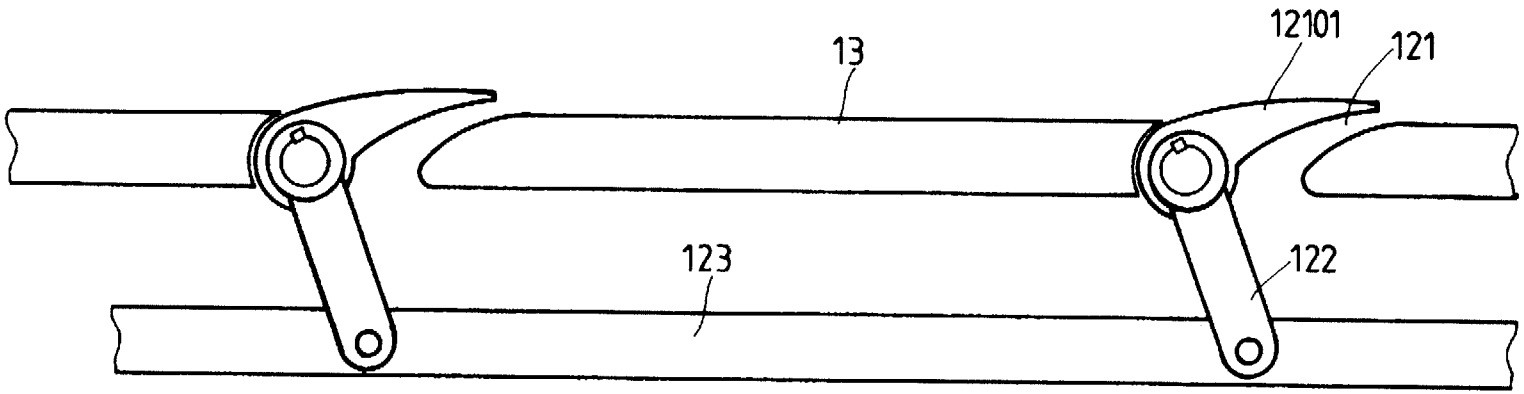
FIG. 11 is a side view of adjustable directing nozzle adapted in the spray dyeing apparatus shown in FIG. 8.
Figure 12:
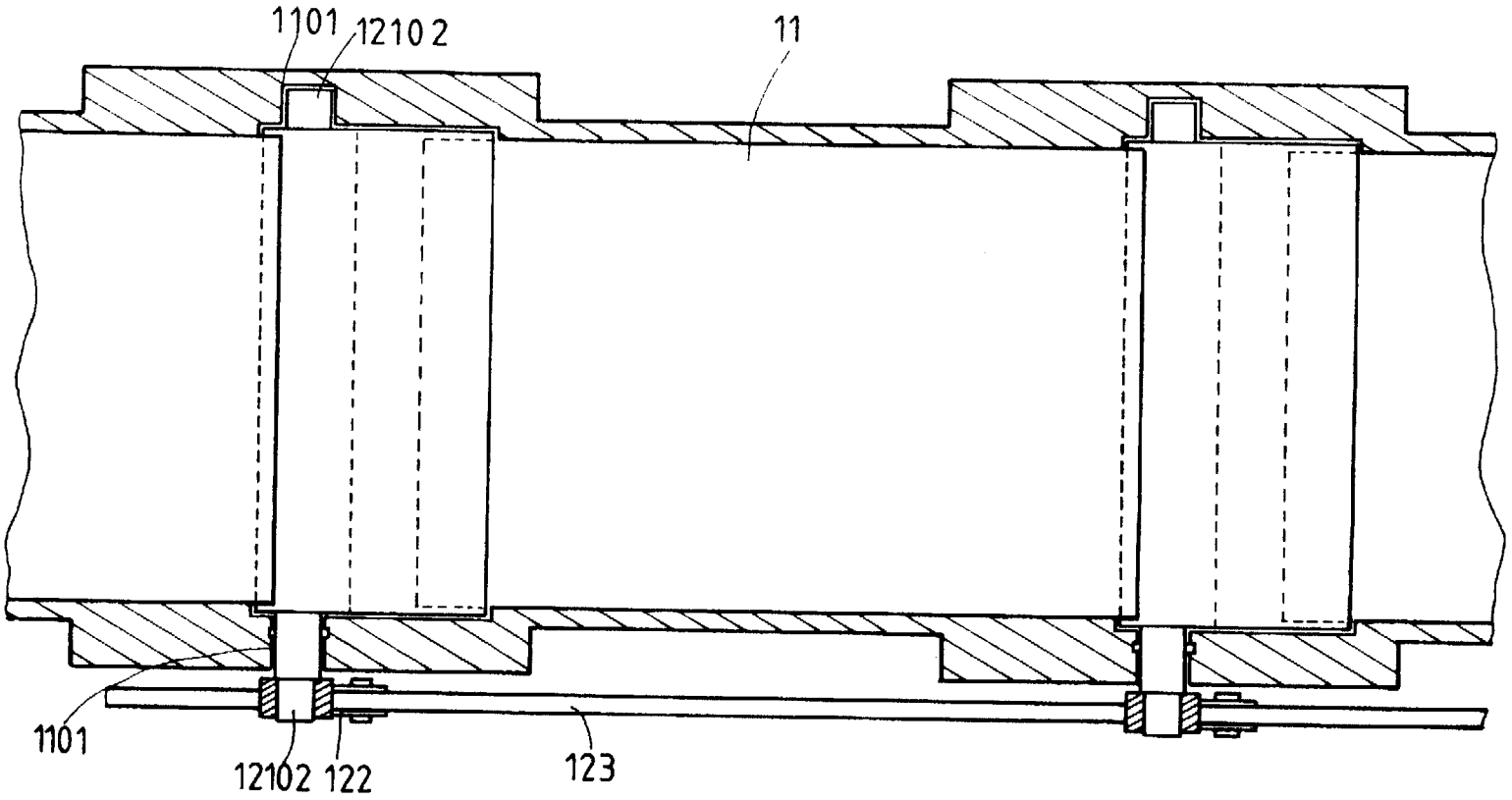
FIG. 12 is a top view of the adjustable directing nozzle.

It should be particularly noted that the directing nozzles 121 that are disposed on the bottom 13 of the fabric guide tube 11 may also be replaced with nozzles of other designs. In accordance with the present invention, a preferred structure for the directing nozzles is shown in FIGS. 11 and 12, which comprises a movable blade 12101, a link bar 122, a driving rod 123. The movable blade 12101 has two opposite pivot pins 12102 pivotally received in bushings 1101 fixed within an opening formed on the base plate 13 of the fabric guide tube 1 to have the blade 12101 to define a spacing with an edge of the opening, which spacing is adjustable by rotating the blade 12101 relative to the base plate 13. The adjustable spacing serves as the directing nozzle 121. One of the pivot pins 12102 of the movable blade 12101 is extended outward and coupled to one end of the link bar 122. The other end of the link bar 122 is pivoted to the driving rod 123 which extends in the direction of the fabric guide tube 11. By connecting the link bar 122 of each of the directing nozzles 121 to the driving rod 123, the directing nozzles 121 may be adjusted simultaneously by moving the driving rod 123 to rotate the blades 12101. The driving rod 123 may be coupled to any suitable power device, such as hydraulic actuation system, electric motor actuation system or other power actuation system to be driven thereby for rotating the blades 12101 in controlling the size of the nozzles 121 and adjusting the jet from the nozzles 121. FIGS. 6 and 7 show more detailed drawings of the nozzle. Further description of the nozzle may be obtained from Taiwan patent No. 89941, Chinese utility model No. ZL 93209236.5, Chinese patent application No. 93105099.5 and U.S. Pat. No. 5,381,678.

Figure 1:
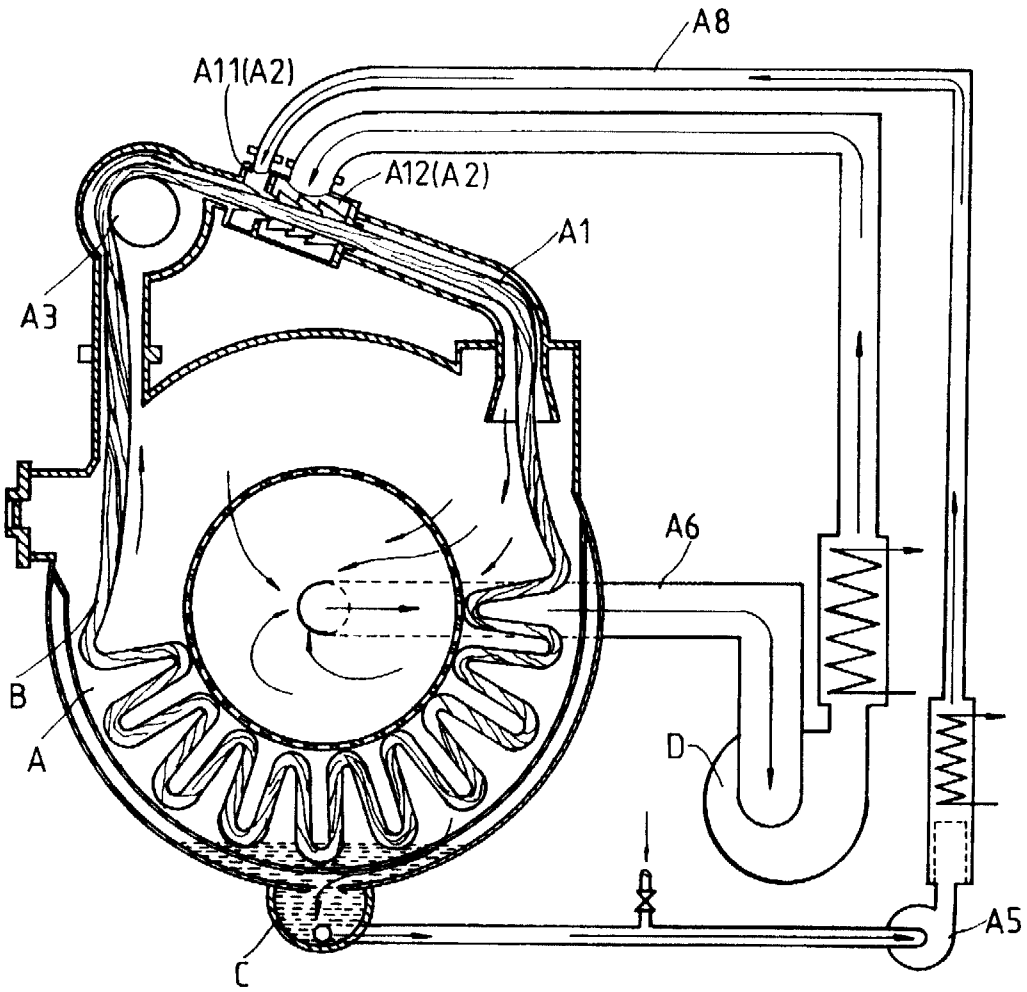
FIG.1 PRIOR ART
FIG. 1 is a schematic side elevational, cross-sectional view showing a conventional air flow type dyeing apparatus.
Figure 2:
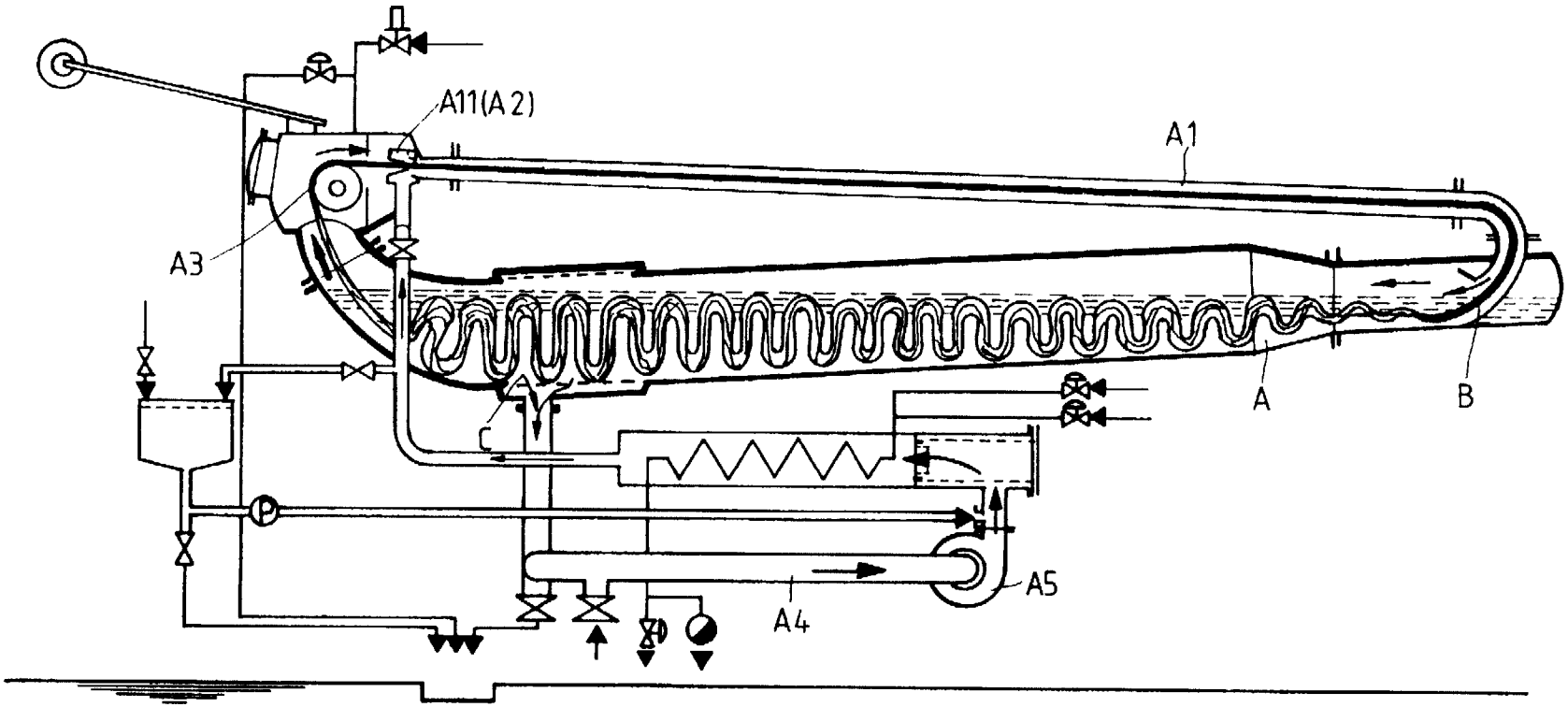
FIG.2 PRIOR ART
FIG. 2 is a schematic side elevational, cross-sectional view showing a conventional liquid flow type dyeing apparatus.
Figure 4A:
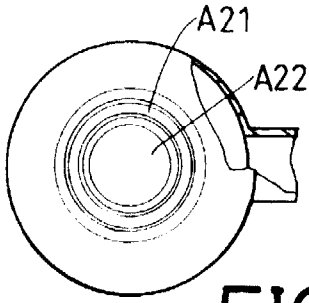
FIG.4A PRIOR ART
FIG. 4A is an end view of the driving nozzle.
Figure 4:
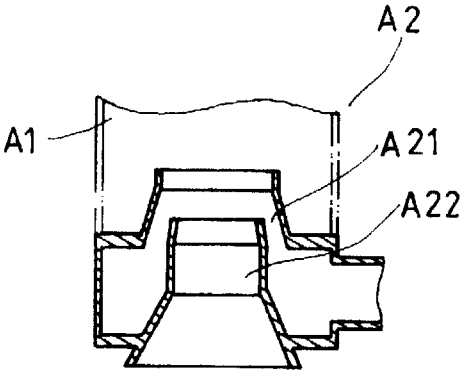
FIG.4 PRIOR ART
FIG. 4 is a cross-sectional view showing a driving nozzle adapted in the conventional liquid flow type dyeing apparatus.
Figure 3A:
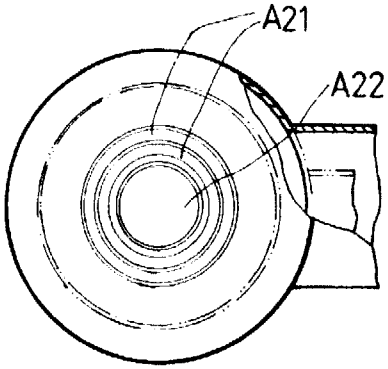
FIG.3A PRIOR ART
FIG. 3A is an end view of the driving nozzle.
Figure 3:
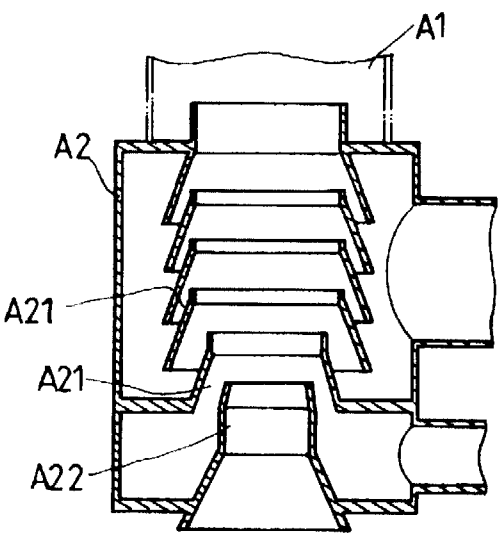
FIG.3 PRIOR ART
FIG. 3 is a cross-sectional view showing a driving nozzle adapted in the conventional air flow type dyeing apparatus.
Figure 5:
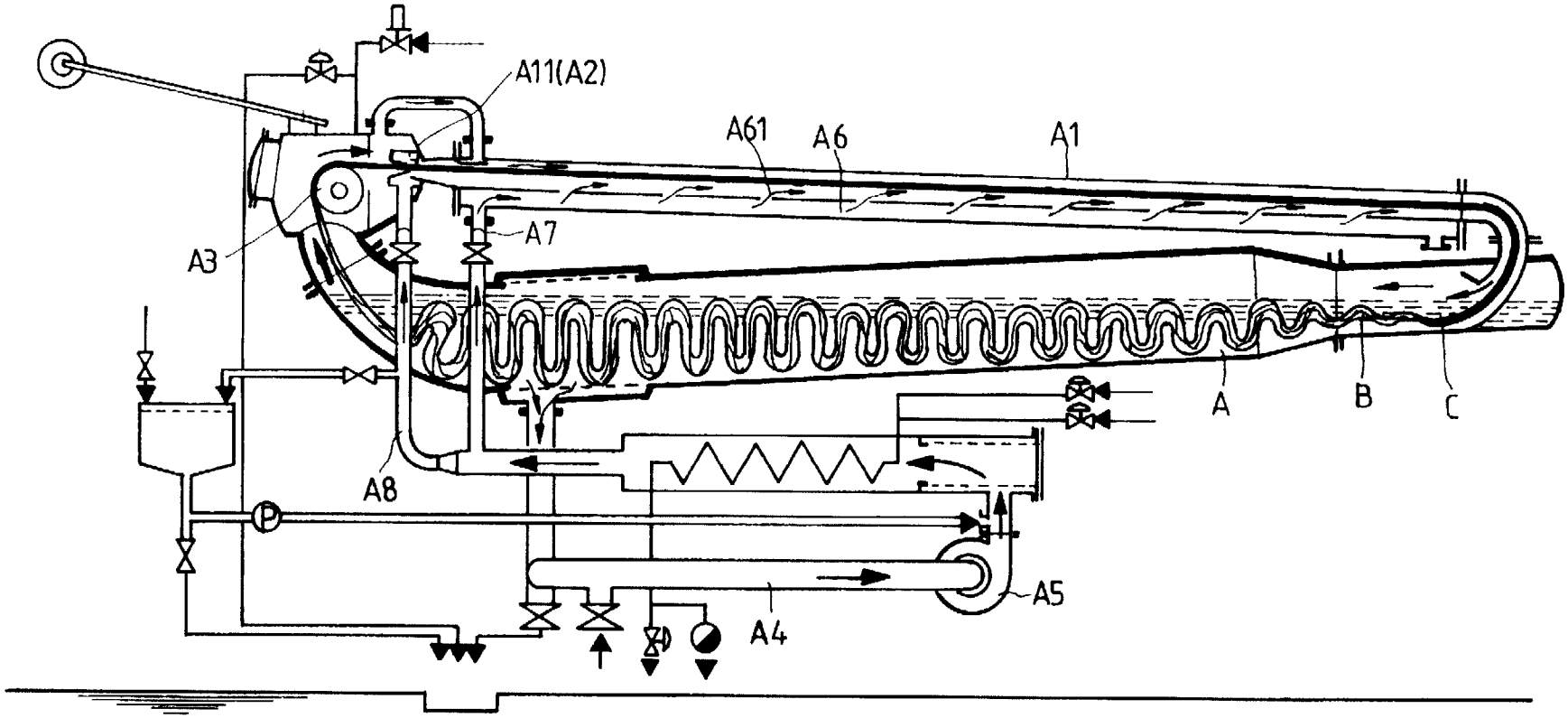
FIG.5 PRIOR ART
FIG. 5 is a schematic side elevational, cross-sectional view showing another conventional liquid flow type dyeing apparatus which is disclosed in Chinese utility model No. ZL 93209236.5, Chinese patent No. 93105099.5 and U.S. Pat. No. 5,381,678.

The feature of the present invention resides in the structure of the fabric guide tube 11 which does not have a narrow nozzle at the upstream inlet that is adapted in the prior art design as indicated at A11 and A12 of FIGS. 1–3, and the throat of the prior art design through which the fabric passes indicating at A22 of FIGS. 3 and 4. The fabric guide tube 11 of the present invention comprises a flat and wide bottom (support plate) extending from the upstream inlet 111 to the downstream outlet 112 and having a width sufficient to allow the fabric to fully expanded breadthwise so that the fabric is in a fully expanded condition in moving through the fabric guide tube 11 and thus allows a more efficient dyeing operation to be performed thereon wherein the dye sprays from the spray nozzles 14 located above the fabric may uniformly fall onto the whole breadth of the fabric 2 from the upper side of the fabric 2. During the movement of the fabric 2 through the fabric guide tube 11, the dye that is sprayed onto the upper side of the fabric 2 penetrates through the thickness of the fabric 2 due to gravity and capillarity of the fiber composed of the fabric 2. The penetration of the dye through the fabric 2 effects dyeing of the fabric 2.

The lower side of the fabric 2 is subject to the air streams from the directing nozzles 121 so as to be floated over the bottom (support plate) 13 of the fabric guide tube 11 and be driven downstream by being impacted by the air streams. The high speed of the air streams under the fabric 2 also creates a lower pressure condition in which the pressure is lower than that above the fabric 2 in which the speed of air flow is much smaller. The difference in pressure between the lower side and the upper side of the fabric 2 is in an un-stable condition due to the air streams from the directing nozzles 121 which, in general, are not precisely uniformly distributed along the length of the fabric guide tube 11 so that the fabric 2 which is fully expanded in moving through the fabric guide tube 11 is subject to a cyclical and violent up-and-down vibration. The higher pressure above the fabric 2 also forms a constraint to the air streams under the fabric 2 to force the air streams to flow partially breadthwise of the fabric 2 (namely in the axial direction of the dyeing apparatus). Such a breadthwise flow of air enhances and maintains the breadthwise expansion of the fabric 2 in moving through the fabric guide tube 11.

When the fabric 2 exits the fabric guide tube 11 at the downstream outlet 112, it is subject to the reciprocal movement of the fabric folding plate 17 which is pivoted to the fabric guide tube 11 at the outlet 112 and controlled to swingingly reciprocate and oscillate about the pivot and is sized to exercise a large area contact with the fabric 2 when the fabric 2 is moved into the fabric storage tank 1. Due to the oscillation of the plate 17 about the pivot thereof, the plate 17 gets into contact with fabric 2 in a periodical manner and the contact engagement between the plate 17 and the fabric 2 folds the fabric 2 in a direction opposite to the moving direction thereof so that a snugly folded configuration of the fabric 2 may be obtained when the fabric 2 moves into the fabric storage tank 1.

The dye that is carried by the fabric 2 into the fabric storage tank 1 is separated therefrom by being driven by gravity to pass through the liquid/air separation net 19 and collected at the lowermost portion of the fabric storage tank 1. The air that is moved with the fabric 2 from the fabric guide tube 11 into the fabric storage tank 1 flows through the upper side holed plate of the fabric storage tank 1 to be collected and conveyed to the blower 1. Except a minor portion of the air which is allowed to flow to the laterally front side of the dyeing apparatus for pressure balance purpose, the air is collected and re-circulated by being drawn away by the blower 16 via the air conveyor tube 161. The air is compressed and sent to the distribution tube 12 to be jetted through the directing nozzles 121 for driving the fabric 2 downstream.

In accordance with Bernoulli's law which states that the higher the speed of a fluid is, the smaller the static pressure it has, the high speed air streams under the fabric 2 creates a high speed and low pressure zone under the fabric 2 which has a pressure lower than that above the fabric 2. The pressure difference between the upper and lower sides of the fabric 2, together with gravity of the fabric 2 and the dye carried thereon, tends to force the fabric 2 toward the high speed air stream zone. This causes a tight contact between the fabric 2 and the high speed air streams and thus increases the momentum transferred from the air streams to the fabric 2 to increase the kinetic energy of the fabric 2. However, the stream lines of the air streams under the fabric 2 limits further movement of the fabric toward the bottom 13 of the fiber guide tube 11 so as to floatingly support the fabric 2 on the air streams and prevent the fabric 2 from getting into directly contact with the bottom 13 of the fabric guide tube 11. Once the fabric 2 is forced to get closer to the bottom 13 by means of the pressure difference across the fabric 2, the air streams are temporarily stopped or "dragged" by the increased shear force between the fabric 2 and the air streams. The energy of the air streams is then converted to a resistance force against the movement of the fabric 2 toward the bottom 13 and rebound the fabric 2 away from the bottom 13. This causes a cyclic vibration (up and down movement) of the fabric 2 inside the fabric guide tube 11. The frequency of the vibration of the fabric 2 is, of course, dependent upon the unit length weight of the fabric and the momentum transferred by the air streams, as well as other factors that are known to those skilled in the field of fluid dynamics. Thus, such a vibration may be, at least partially, controlled by adjusting the opening size of the directing nozzles 121 or by changing the power input to the blower 16.

The cyclic vibration of the fabric involves a massive transfer or conversion of energy which causes the fibers of the fabric 2 to become loosened, thus enhancing the penetration of the dye into the fabric 2 and increasing the absorbability and diffusion of the dye within the fabric 2 so that besides increasing the moving speed of the fabric 2 and providing a dyeing operation with a small quantity of dye, high concentration, high efficiency, low energy consumption, low bath ratio and low pollution, the present invention helps to loosen the fibers within the fabric so as to enhance the removal of un-wanted matters or impurities from the fabric, increasing the operation efficiency of for example rinsing, cleaning, bleaching and thus increase the overall efficiency of the dyeing operation.

Although preferred embodiments have been described to illustrate the present invention, it is apparent that changes and modifications in the specifically described embodiments can be carried out without departing from the scope of the invention which is intended to be limited only by the appended claims.

What is claimed is:

1. A fabric treating apparatus comprising a fabric storage tank extending in an axial direction and adapted to receive therein fabric of a given breadth to be treated and a fabric guide tube extending in the axial direction, the fabric storage tank and the fabric guide tube being connected to and in fluid communication with each other at a laterally front side and an opposite laterally rear side to define a continuous path for the fabric to continuously circulate therein from the fabric storage tank into the laterally front side of the fabric guide tube to move through the fabric guide tube to the laterally rear side of the fabric guide tube and then back into the fabric storage tank, the improvements comprising:

the fabric guide tube comprising a bottom wall extending from a laterally front end upstream inlet of the fabric guide tube to a laterally rear end downstream outlet, having a flat width sufficient to allow the fabric to fully expand breadthwise in moving through the fabric guide tube, the fabric guide tube comprising at least one spray nozzle mounted therein above an upper side of the fabric to receive a first, fabric treating fluid from a first fluid supply and to spray the first fluid onto the upper side of the fabric substantially across the breadth of the fabric in an atomized form of the first fluid so as to enhance diffusion and penetration of the first fluid into the fabric to allow the fabric to be treated by the first fluid in an efficient manner, the bottom wall of the fabric guide tube having a plurality of directing nozzles in communication with a supply of a second fluid via a second fluid conveyor tube for jetting high speed streams of the second fluid into the fabric guide tube in the downstream direction under a lower side of the fabric, the directing nozzles being spaced from each other at a given distance in the moving direction of the fabric, which distance between adjacent directing nozzles defining a support surface for constraining and guiding the streams of the second fluid in the downstream direction for carrying the fabric downstream by impacting the fabric and establishing shear force therebetween, the high speed streams of the second fluid under the lower side of the fabric creating a low pressure zone under the fabric which has a pressure lower than pressure on the opposite upper side of the fabric so as to have a pressure difference between the upper side and the lower side of the fabric which, together with the spaced arrangement of the directing nozzles, causes a violent vibration on the fabric which moves the fabric toward and away from the bottom of the fabric guide tube in a repeated manner, the pressure difference also tending to force the fabric toward the high speed streams of the second fluid so as to result in an efficient energy transfer therebetween to increase moving speed of the fabric, the fabric being floatingly supported above the bottom of the fabric guide tube by means of the high speed streams of the second fluid from the directing nozzles to be breadthwise expanded and fast moved through the fabric guide tube, the fabric being substantially fully expanded in the breadth direction due to the wide bottom wall of the fabric guide tube, so that a treatment of the fabric with high efficiency, low energy consumption, low bath ratio and low pollution is achieved.

2. The fabric treating apparatus as claimed in claim 1, wherein each of the directing nozzles comprises an opening formed on the bottom wall of the fabric guide tube and in fluid communication with the second fluid conveyor tube to receive the second fluid from the second fluid supply, a movable blade pivoted within the opening to define a fluid passage and to be rotatable relative to the opening between an open position, through a plurality of intermediate position, to a closed position for adjusting cross-sectional size of the fluid passage, a driving rod to which the movable blade is pivotally coupled by means of a link member so that by moving the driving rod, the movable blades of the directing nozzles are adjusted simultaneously, a control device being provided to the driving rod to control the movement of the driving rod so as to adjust the directing nozzles and thus the high speed streams from the directing nozzles.

3. The fabric treating apparatus as claimed in claim 1, wherein the fabric guide tube comprises a fabric folding plate pivotally supported inside the fabric folding plate substantially at the downstream outlet thereof to be reciprocally movable between an action position and an idle position, the fabric folding plate having a size to be in contact engagement with the fabric when the plate is at the action position and forcing the fabric in a direction opposite to the movement of the fabric so as to fold the fabric in a substantially snug manner when the fabric moves from the downstream outlet of the fabric guide tube into the fabric storage tank.

4. The fabric treating apparatus as claimed in claim 1, wherein the first fabric treating fluid comprises a dye liquid and the second fluid comprises air and wherein the fabric storage tank comprises a holed wall to allow the air moving with the fabric from the fabric guide tube into the fabric storage tank to be separated from the fabric and the dye liquid and collected and conveyed to the second fluid supply.

5. The fabric treating apparatus as claimed in claim 1, wherein the first fabric treating fluid comprises a dye liquid and the second fluid comprises air and wherein the fabric storage tank comprises a liquid/air separating net disposed therein at such a location to receive and support the fabric exiting from the downstream outlet of the fabric guide tube so as to allow the dye liquid to pass through the net and thus separate from the fabric to be collected and conveyed back to the spray nozzles.

6. The fabric treating apparatus as claimed in claim 1, wherein the supply of the second fluid comprises a blower which drives air to the directing nozzles.

7. The fabric dyeing apparatus as claimed in claim 6, wherein a heat exchanger is disposed between the blower and the directing nozzle for adjusting temperature of the air.

8. The fabric dyeing apparatus as claimed in claim 6, wherein a second fluid return tube is connected between the blower and the fabric storage tank which collects and receives air moving with fabric from the fabric guide tube into the fabric storage tank and conducts the air to the blower to be conveyed to the directing nozzles.

9. The fabric treating apparatus claimed in claim 1, wherein the first fluid comprises a liquid dye and the second fluid comprises air, the fabric storage tank comprising a liquid/air separation net disposed therein for receiving and supporting thereon the fabric from the downstream outlet of the fabric guide tube so as to allow the liquid dye carried within the fabric to pass therethrough and separate from the fabric, the liquid dye being collected and conveyed back to the first fluid supply to be conveyed to the spray nozzles again.

10. The fabric treating apparatus as claimed in claim 9, wherein the first fluid supply comprises a pump.

11. The fabric treating apparatus as claimed in claim 10, wherein a filter is provided between the pump and the spray nozzles for cleaning the liquid dye.

12. The fabric treating apparatus as claimed in claim 10, wherein a heat exchanger is provided between the pump and the spray nozzles for adjusting temperature of the liquid dye.

13. The fabric treating apparatus claimed in claim 1, further comprising a fabric driving wheel mounted at the upstream inlet of the fabric guide tube for driving the fabric from the fabric storage tank into the fabric guide tube.

14. The fabric treating apparatus as claimed in claim 1, wherein a by-pass tube is provided between the first fluid supply and the directing nozzles and controlled by valve means so as to selectively conducting the first fluid to the directing nozzles.

15. The fabric treating apparatus as claimed in claim 14, wherein valve means is provided between the second fluid supply and the directing nozzles to cut off the supply of the second fluid to the directing nozzles and wherein the first fluid comprises fresh water to be supplied to both the upper and lower sides of the fabric via the spray nozzles and the directing nozzles to carry out a rinsing operation on the fabric.

* * * * *